US005377919A

United States Patent [19]

Rogers et al.

[11] Patent Number: 5,377,919

[45] Date of Patent: Jan. 3, 1995

[54] HAMMERMILL

[75] Inventors: Chester D. Rogers, Olathe; Walter L. McLain, Gardner, both of Kans.

[73] Assignee: The Toro Company, Bloomington, Minn.

[21] Appl. No.: 47,549

[22] Filed: Mar. 8, 1993

[51] Int. Cl.[6] ..... B02C 13/04

[52] U.S. Cl. ..... 241/189.2; 241/194; 241/197; 241/293

[58] Field of Search ..... 241/194, 189.2, 197, 241/293, 287

[56] References Cited

U.S. PATENT DOCUMENTS

| | | | |
|---|---|---|---|
| 1,281,829 | 10/1918 | Plaisted | 241/194 |
| 1,647,555 | 11/1927 | Wells | 241/194 |
| 1,767,921 | 6/1930 | Gately | 241/194 |
| 3,252,276 | 5/1966 | Brewer | 241/194 |
| 4,082,231 | 4/1978 | Gould | 241/187 |
| 5,161,746 | 11/1992 | Bliss | 241/189.2 |

FOREIGN PATENT DOCUMENTS

| | | | |
|---|---|---|---|
| 2097649 | 5/1987 | Japan | 241/197 |

*Primary Examiner*—Mark Rosenbaum
*Assistant Examiner*—John M. Husar
*Attorney, Agent, or Firm*—David George Johnson

[57] ABSTRACT

A hammermill is presented which includes a plurality of hammers each presenting an arcuate striking profile. The hammermill includes a rotor having rods for swingable carrying the hammers thereon and a motor for rotating the rotor. The hammers are longitudinally spaced along the rotor and preferably helically arrayed thereabout. The hammers present a head and a body, the head having an arcuate striking face which may include a point. As the rotor turns, the hammers are free to swing on the rods and comminute material fed into the hammermill. The hammers preferably present symmetrical striking profiles whereby after one profile becomes worn, the position of the hammer on the rod may be reversed to increase the useful life thereof.

9 Claims, 6 Drawing Sheets

HAMMERMILL

BACKGROUND OF THE INVENTION

1. Field of the Invention

This invention concerns a hammermill for comminuting material received therein having hammers presenting an arcuate striking profile or face. The hammers include a substantially cylindrical body and a striking head at the remote end thereof.

2. Description of the Prior Art

A number of different devices rely on the use of hammers which are typically mounted on a rotor or reel and strike objects to be reduced in size. Such devices, broadly designated hammermills, are used in the mineral ore processing industry, the grain processing industry, and in many agricultural applications such as tub grinders and the like. The hammermills include a suitable drivetrain for rotating the rotor or reel to bring the hammers into engagement with the material to be comminuted or reduced. For example, railroad ties, lumber, ore, limbs, brush or other material are introduced into a chamber and then hit by the hammers of the hammermill to reduce the material in size. Once reduced to the desired size, the material passes out of the housing for subsequent use.

Prior hammermills have had hammers which present a square or flat face to accomplish this result. The size and type of material may dictate conditions such as speed, number of hammers, and horsepower necessary to power the apparatus. Two problems which have been particularly difficult to overcome have been the wear characteristics of the hammers and the amount of power or energy consumed during operation.

Because of the configuration of prior hammers, only a single striking profile is often presented, such that when the striking face becomes worn, the entire striking element must be replaced. Because of the tremendous shock applied to the hammer and the deformation of the striking element during use, the useful life of a hammer is an important consideration in hammer development and manufacture.

The other problem frequently encountered is the considerable amount of energy necessary to power the hammermill to attain a desired level of output. Because of the configuration of the striking element of prior art hammers used in hammermills, the hammers have had to crush and deform the material. When large and tough materials such as railroad ties are to be processed, horsepower and energy requirements have been high in order to break the ties into chips or the like.

There has thus developed a real need for an improved hammermill having a hammer design which will be durable, provide extended useful life, attain good material comminution, and reduce the energy consumption of the hammermill as a whole.

SUMMARY OF THE INVENTION

These objects have largely been met by the hammermill of the present invention. That is to say, the hammermill as shown herein includes hammers which are configured to present an increased overall useful hammer life, effectively reduce the material introduced therein to a desired size, and not only reduce the amount of energy consumed for comminuting a desired material but also perform this task in less time to achieve a demonstrable improvement in overall efficiency.

The hammers of the present invention are uniquely configured to present an arcuate striking profile. The arcuate surface allows the hammer to progressively engage the material rather than necessitating that the material be engaged simultaneously across a line transverse to the direction in which the hammer swings. The hammer preferably presents a substantially cylindrical appearance and may be provided with a coating of hardening material to increase the hardness of the hammer at the position thereon where most engagement with the material will occur. In alternative embodiments, a point may be oriented toward the material to be engaged, or the hammer may presented a tapered striking profile resulting in a waisted appearance. In this latter embodiment, the material contacted by the striking profile will typically be directed downwardly in a desired direction for subsequent collection. The hammers are preferably symmetrical about a bisecting transverse plane so that when one striking profile becomes worn, the hammer may be reversed to place a new striking profile in position, thus doubling the useful life of the hammer.

The hammers are preferably used in a hammermill such as a tub grinder which includes a housing for receiving the material therein, a rotor on which the hammers are mounted, and a motor for driving the rotor. A screen may be located beneath the rotor to limit the size of material allowed to pass therethrough. The hammers are mounted to swing on longitudinally extending rods and spaced both circumferentially and longitudinally to present a spiral arrangement about the rotor. Thus, the rotation of the rotor brings the hammers into engagement with the material and the hammers are free to swing on the rods. After the material is sufficiently reduced in size to yield the desired product, it may pass through the screens, and a conveyor may be used to move the product to a remote location.

The arcuate striking profile on the hammer presents a unique approach to hammers used in hammermills and the like. It provides a hammer which is relatively easy and inexpensive to manufacture. The arcuate striking face is preferably circular and thus provides progressive loading on the hammer wherein the leading edge of the striking profile acts as a point to cleave the material, with the remaining portions of the arcuate surface acting as a wedge to widen the opening as well as strike a blow thereto. As a result, the material breaks open more readily than with conventional hammers used in hammermills and the overall efficiency of the hammermill is increased. This is believed to result from the combination of the aforementioned "cleaving" effect combined with the ample mass yielding a striking or crushing effect.

DESCRIPTION OF THE PREFERRED EMBODIMENT

Figure 1:
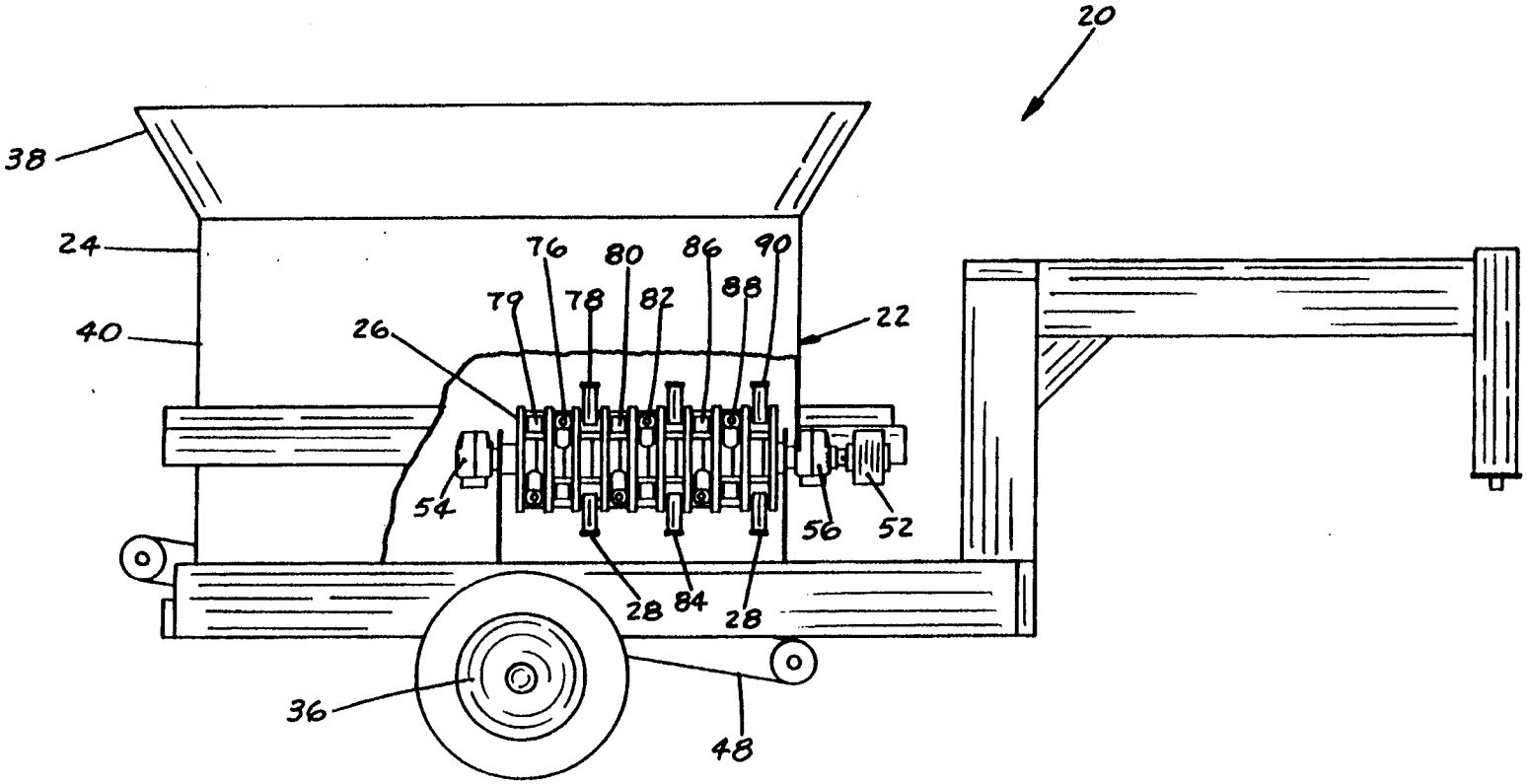
FIG. 1 is a side elevational view of a hammermill in accordance with the present invention, with portions of the surrounding housing being broken away to show the rotor and hammers mounted thereon.
Figure 2:
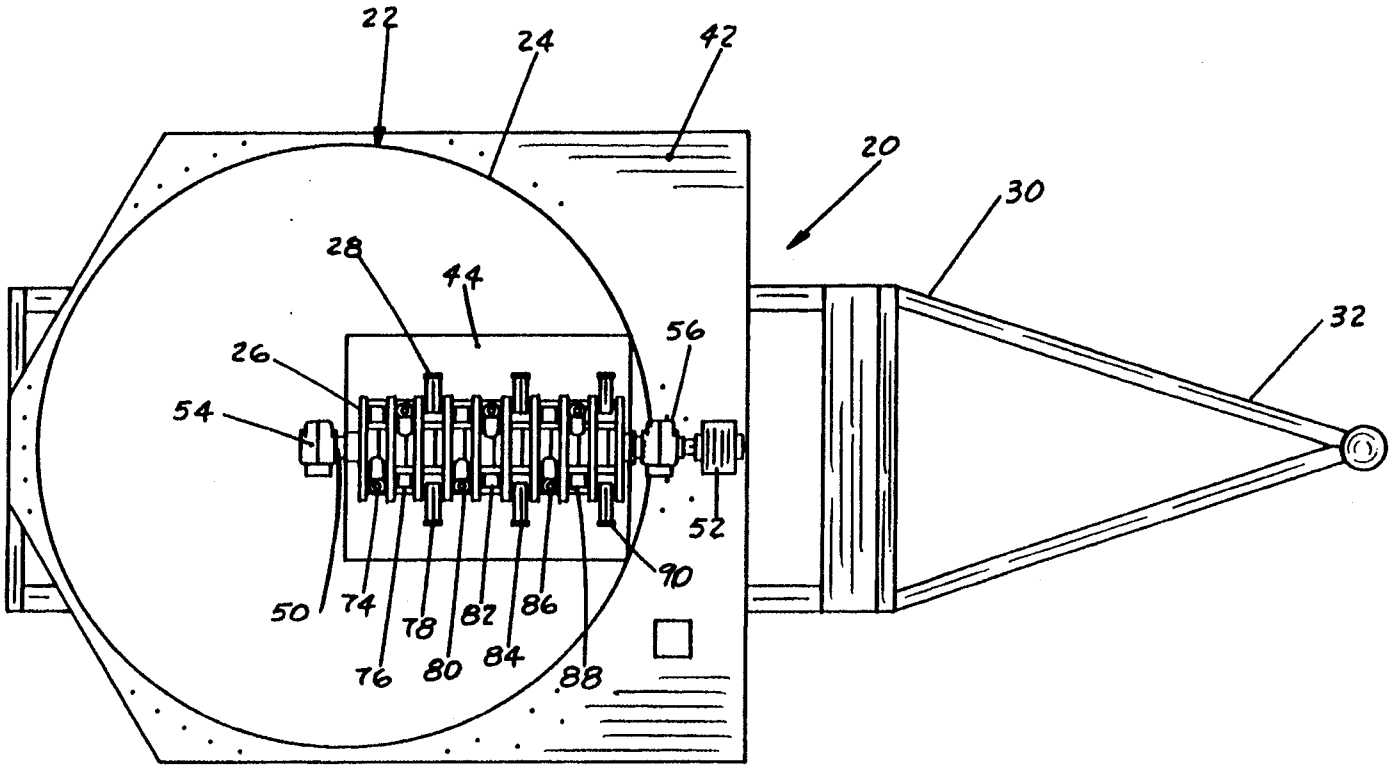
FIG. 2 is a top plan view of the hammermill hereof.
Figure 3:
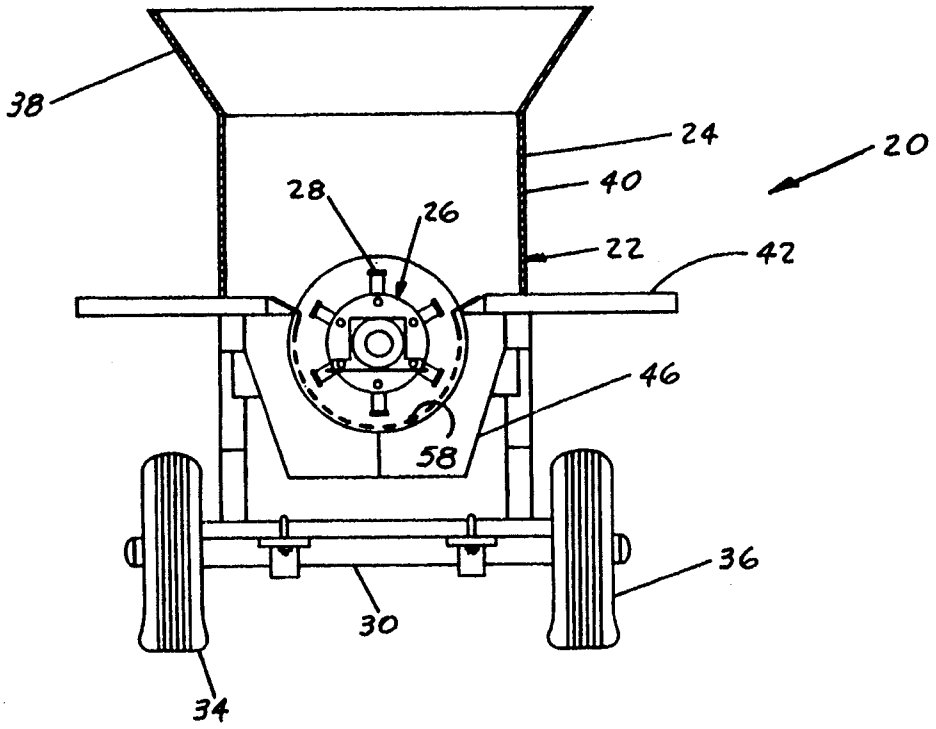
FIG. 3 is a vertical cross sectional view of the hammermill hereof showing the screens positioned below the rotor.

Referring now to the drawings, a hammermill 20 is shown in FIGS. 1, 2 and 3. The hammermill 20 shown and described herein is more particularly a tub grinder 22, but it is to be understood that the principles hereof are applicable to hammermills of many varieties. The tub grinder 22 shown herein is particularly useful for receiving material such as timbers, lumber, branches and bushes in a housing 24. The housing 24 is adapted for rotation about a central upright axis whereby the material is brought into engagement with a rotor 26 mounting a number of hammers 28 thereon. The tub grinder 22 is mounted on a mobile carriage 30 including a tongue 32 and wheels 34 and 36 for towing the tub grinder 22.

The housing 24 presents a flared upper section 38 and a cylindrical tub 40. A deck 42 extends horizontally outwardly from the tub 40 and into the housing 24, whereby it defines a floor on which the tub 40 rests and rotates. The deck 42 presents an opening 44 therein, with rotor 26 positioned centrally therein. A chute 46 depends from the bottom of the housing 24 for directing the flow of comminuted product downwardly onto a discharge conveyor 48. The conveyor 48 receives the product thereon and conveys it to the rear of the tub grinder 22 for transfer or discharge onto the ground.

The rotor 26 is shown oriented in a fore-and-aft configuration, although alternate orientations are possible. The rotor 26 includes a longitudinally extending shaft 50 operatively coupled to a drive motor 50. The drive motor 52 is preferably a hydraulic motor capable of bi-directional rotation, so that the rotor may be driven either clockwise or counterclockwise as viewed in FIG. 3. The shaft 50 of the rotor 26 is supported by bearing blocks 54 and 56 at either end thereof. A screen 58 presents mesh openings therein of a desired dimension for permitting the product, when reduced to tile desired size, to pass therethrough. Product of a greater size than that of the mesh opening is retained on the screen 58 and engaged by the hammers 28 until reduced to the desired size to pass through the mesh openings.

Figure 4:
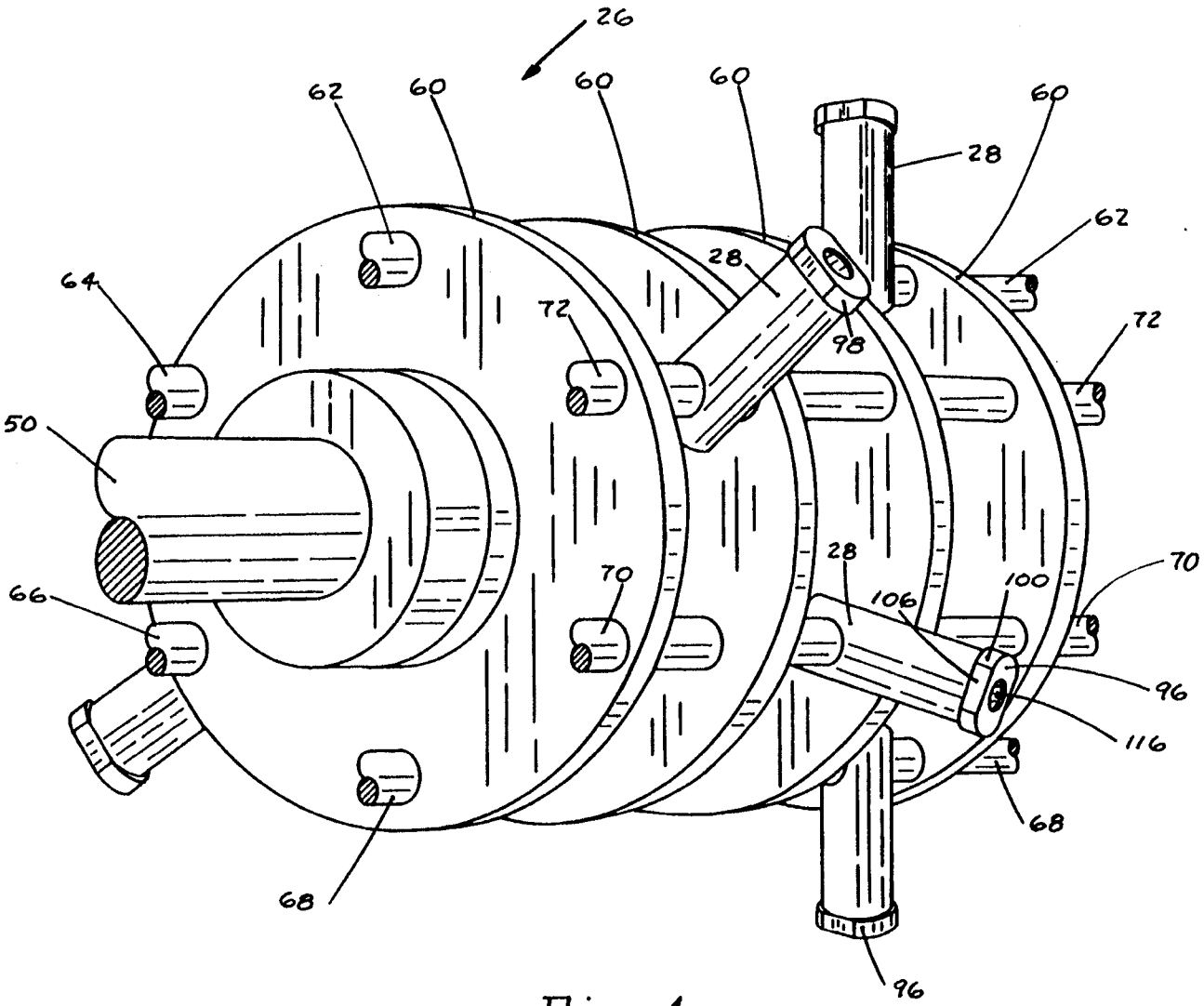
FIG. 4 is an enlarged fragmentary perspective view of the rotor for use in the hammermill hereof, with the spacing between adjacent disks thereon being exaggerated to show the mounting of the hammers.

Rotor 26 includes longitudinally extending shaft 50 which carries a series of discs 60 at longitudinally intervals therealong. The actual spacing between the discs 60 is shown in FIGS. 1, 2 and 3, while the spacing between the discs 60 is exaggerated in FIG. 4 to show the rods 62, 64, 66, 68, 70 and 72. The rods extend longitudinally and interconnect the discs 60. The hammers 28 are swingably coupled to the rods, with the hammers located in a common plane between the same pair of adjacent discs 60 defining a rank. In the embodiment shown in FIGS. 1, 2 and 3, nine ranks 74, 76, 78, 80, 82, 84, 86, 88 and 90 are shown, although fewer or greater ranks may naturally be present. The hammers 28 are preferably coupled to selected rods whereby a helical pattern is presented. The hammers 28 in one rank are coupled to different rods than hammers 28 in the ranks immediately adjacent thereto to more evenly load the rotor 26 during reduction of the material therein.

Each hammer 28 presents a body 92 which is substantially cylindrical in configuration. In addition, the body 92 is preferably solid rather than hollow to provide greater mass for striking the material. The body is of a diameter slightly less than the spacing between adjacent discs 60 and is coupled to the rods by a transversely extending aperture 94 therethrough. In the embodiment shown in FIGS. 5–8, a striking head 96 is provided which includes an arcuate first striking profile 98 and an arcuate second striking profile 100. The first and second striking profiles are symmetrical about a bisecting plane extending through the longitudinal axis of the body 92 and transverse to the intended path through which the hammer 28 moves with rotor 26.

Figure 7:
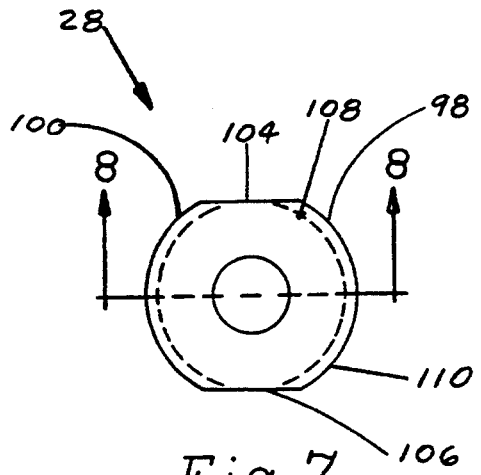
FIG. 7 is a top plan view of the hammer of FIG. 5.
Figure 6:
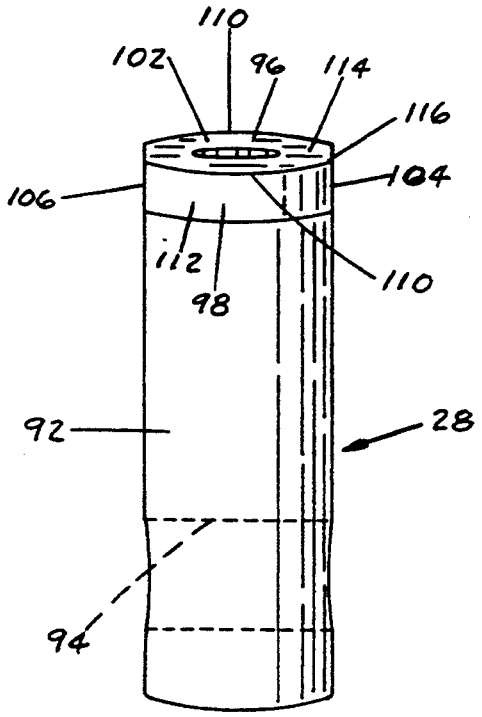
FIG. 6 is a front pictoral view of the hammer of FIG. 5.
Figure 5:
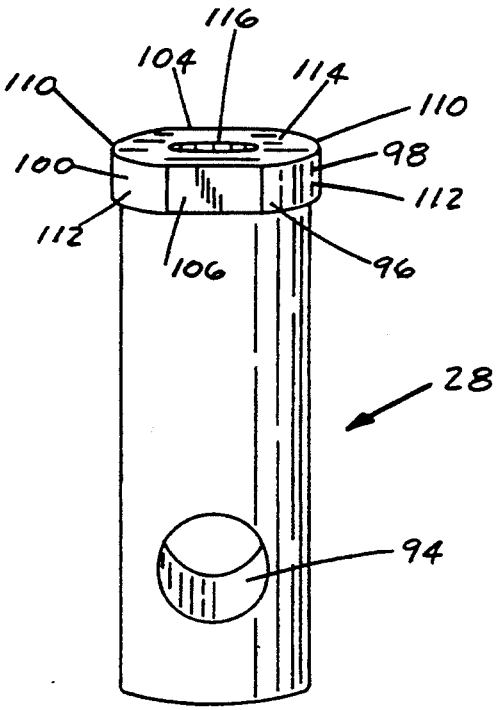
FIG. 5 is a side pictoral view of a hammer in accordance with the present invention.

The striking head 96 is formed of an application of hardening coating 102 which is bonded to the body 92 by, for example, welding. Preferably, the coating 102 is applied by welding a high grade steel alloy having a mixture of about 60% tungsten carbide in an oxy-acetylene process. The hammers are preheated to approximate 1000 degree Fahrenheit prior to applying the coating 102, and thereafter heat treated to a valve of 45–59 on the Rockwell C scale. The coating 102 is provided of high-carbon steel, tungsten carbide or other hard material which will resist wear during use. The first and second striking profiles present substantially an arc of a circle when viewed in plan, as shown in FIG. 7, and are separated by substantially fiat side surfaces 104 and 106. The flat side surfaces 104 and 106 are substantially tangential to the circumference 108 of the body 92, shown in phantom in FIG. 7. Thus, the hammers 28 are free to swing about their respective rods without substantial contact with the discs 60. The striking profiles 98 and 100 present upper striking margins 110 which present an edge separating the arcuate face 112 and the substantially flat top surface 114. The coating 102 does not extend to the center of the top of the body 92 and thus defines a recess 116 surrounded by the coating 102.

Figure 10:
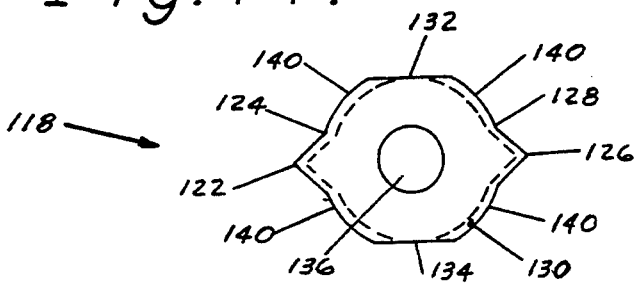
FIG. 10 is a top plan view of the embodiment shown in FIG. 9.
Figure 8:
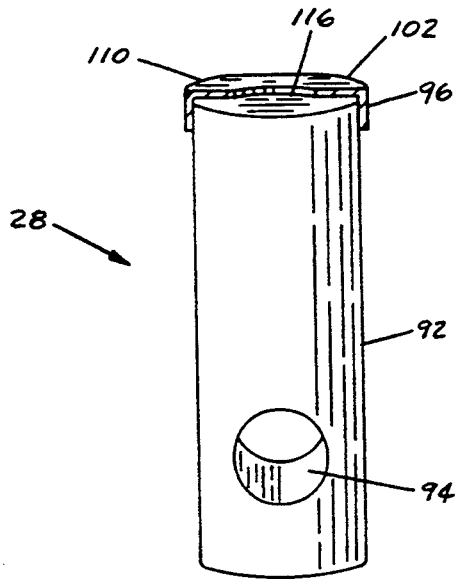
FIG. 8 is a side pictoral view similar to FIG. 5 but including a cross-section of the hardening coating taken along line 8—8.
Figure 9:
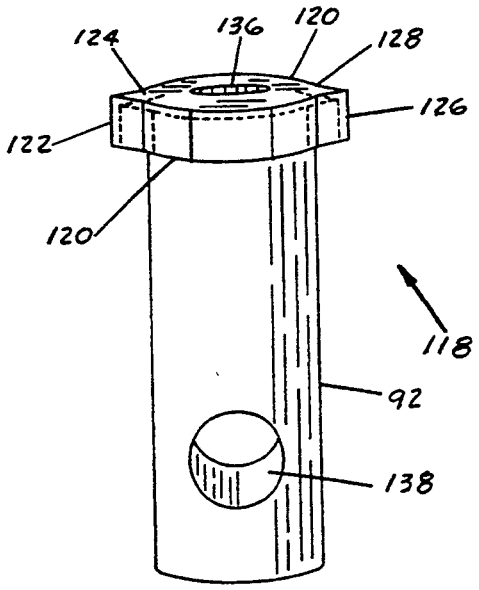
FIG. 9 is a side pictoral view of an alternate embodiment of the present invention including a leading a trailing point, with portions of the hammer shown in phantom.

Hammer 118 is similar to hammer 28 in that both share the same cylindrical body 92. However, the striking head 120 of hammer 118 is slightly modified to present a first point 122 on first striking profile 124 and a second point 126 on second striking profile 128. As is shown in phantom in FIG. 9 and FIG. 10, the striking head 120 is configured so that the coating 130 is applied and bonded to an even thickness over the striking head 120, except for an area of reduced thickness along flat side surfaces 132 and 134. A recess 136 is provided at the center of the striking head 120, with the first striking profile 124 being on the opposite side of the striking head 120 than the second striking profile 128, whereby the striking head 120 is substantially symmetrical about a transversely extending bisecting plane passing through aperture 138 when viewed in plan. The hammers 118 are mounted on the rotor 26 identically with hammer 28, and thus one of the points 122 or 126 will be positioned to engage the material in either direction of rotation of the rotor 26. The striking profiles 124 and 128 include arcuate faces 140 between the points and the side surfaces which engage the material and aid in the cleaving and reducing action initiated by the points 122 and 126.

Figure 11:
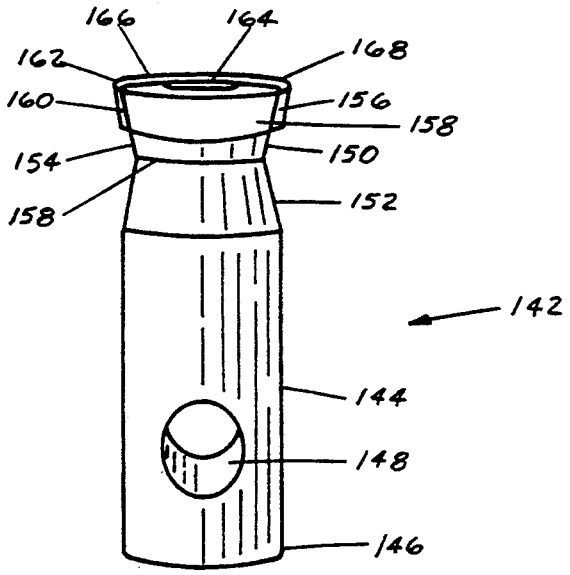
FIG. 11 is a pictoral view of a second alternate embodiment of the present invention showing a radially inwardly tapering striking profile.

Hammer 142 represents a second alternate embodiment and is shown in FIG. 11. The body 144 of the hammer 142 is similar to the previously described hammers 28 and 118 in that it includes a proximate portion 146 which includes an aperture 148 for mounting to the rods carried by the rotor 26. The body 144 differs from the prior embodiments in that the remote portion 150 presents an hourglass or waisted segment 152 including tapered neck 154 which narrows from the striking head 156 to the waist 158. The striking head 156 presents arcuate striking profiles 158 and 160 which are also of a reduced cross-sectional area nearer the aperture 148 than near the top surface 162. Again, a coating of hardening material is bonded to the hammer 142 and thereby defines a recess 164 in the center thereof. The striking head 156 thus presents the appearance of an inverted frustoconical section when the hammer 142 is in an upright position with the striking margins 166 and 168 at the top thereof.

In use, the hammermill 20 receives material into the housing 24. The material falls into the opening 44 where it is engaged by the hammers 28, 118 or 142, depending on which hammers are mounted on the rotor 26. The hammers strike the material, often repeatedly, until the material is crushed, chipped, or otherwise reduced in size to pass through the mesh openings in the screen 58. The motor operates to rotate the shaft 50 and thus the rotor 26 in either a clockwise or counterclockwise direction as viewed in FIG. 3.

Because the material enters the housing 24 and then the opening 44 from the top, the hammers strike the material when moving across the uppermost part of their generally circular path through a plane transverse to the longitudinal axis of the shaft 50. As a result, the striking head of the hammer usually engages the material at the edge formed between the face of the striking profile and the top surface. Essentially, the striking profile thus presents a leading point of engagement at the forwardmost point of the striking profile so that the engagement with the material is progressive, with the trailing portions of the arcuate striking profile coming increasingly into engagement as the striking head moves forward into the material. A cleaving effect results. This cleaving effect, coupled with the hammering effect caused by the mass of the hammer, cleaves and breaks the material into pieces, which then fall through the screen and the discharge chute as the desired product. When hammer 118 is used, the cleaving effect is more pronounced, yet the arcuate faces of the striking profile still serve to cleave, break and otherwise separate the material into smaller components. In the case of hammer 142, the arcuate face still leads the striking head into the material, but the tapering of the striking profile toward the proximate portion tends to deflect the broken material downwardly toward the screen. As a result, less material is scattered within the housing 24.

In practice, the hammers 28 used in the present invention have achieved a remarkable and unexpected improvement over prior hammer and hammermill arrangements. In a first test, a hammermill operating with a 300 hp diesel engine running at 1900 rpm and mounting forty-eight standard 1 inch square hammers in a spiral pattern using 1 inch screens to process compost having a 5% sand mix with the exception of the number and configuration of hammers, the hammermill was substantially the same as hammermill 20 hereof. After one hour of operation, 9 tons of compost were processed using 14.5 gallons of fuel. In contrast, when hammermill 20 was used (again powered by a 300 hp diesel engine running at 1900 rpm and processing compost having a 5% sand mix), 13.5 tons of compost were processed using only 12.8 gallons of fuel. The hammermill 20 mounted twenty-four hammers 28 each having a nominal diameter of 2⅝ inch. Thus, by substituting the hammers 28 of the present invention, 50% more compost was processed with 12% less fuel.

As noted previously, the hammers are free to swing on the rods. Centrifugal force causes the hammers to extend substantially radially to engage the material deposited into the housing 24, and as the hammers engage the material, they are free to swing rearwardly and thus yield, thereby reducing the impact shock transmitted through the shaft 50. Because the motor 52 is preferably a hydraulic motor and can rotate the rotor bi-directionally, the hammers hereof are uniquely able to function in either direction of rotation, an important consideration when large or tough material is encountered which would jam the rotor 26 in one direction but which might be dislodged or reduced when the direction of rotation is reversed. The symmetry of the hammers also favorably permits the hammers to be reversed on their respective rods when one striking profile becomes worn as a result of continuous operation in one direction.

We claim:

1. A hammermill for comminuting material received therein comprising:

means for supporting a plurality of hammers such that each hammer rotates in a plane about a longitudinal axis;

drive means for rotating said hammer support means about said longitudinal axis;

a plurality of hammers, each hammer being formed to include a proximate end and a remote end, the remote end being shaped as a modified right cylinder, the right cylinder having a curved surface on each of two opposing sides of the right cylinder, the two opposing curved sides being joined by substantially flat surfaces, each flat surface being parallel to a diameter of the right cylinder, the diameter bisecting a midpoint of each of the two opposing curved sides of the right cylinder; and means coupling said plurality of hammers to said support means at circumferentially spaced intervals thereabout whereby said hammers extend radially outward from said hammer supporting means during rotation thereof, each of said hammers presenting the curved surfaces thereon for engaging the material to be comminuted.

2. A hammermill as set forth in claim 1, wherein said drive means is operable for bi-directional forward and reverse rotation of said supporting means.

3. A hammermill as set forth in claim 1, wherein said hammers are arranged to present a plurality of ranks of hammers, each of said ranks being longitudinally spaced along said support means whereby each rank rotates in the same plane.

4. A hammermill as set forth in claim 3, wherein said support means includes a plurality of longitudinally spaced plates disposed for separating adjacent ranks of hammers.

5. A hammermill as set forth in claim 3, wherein the hammers in each rank are substantially equally circumferentially spaced and the hammers within a rank are circumferentially spaced relative to the hammers in an adjacent rank to present a helical arrangement of hammers along the length of the support means.

6. A hammermill as set forth in claim 5, wherein said support means includes a central shaft and said coupling means includes a plurality of longitudinally extending rods radially spaced from said shaft and circumferentially spaced thereabout.

7. A hammermill as set forth in claim 6, wherein said remote end presents a striking point, wherein said striking point resides on the diameter bisecting the midpoint of the two opposing curved sides of the right cylinder.

8. A hammermill as set forth in claim 1, wherein said hammers include a substantially cylindrical body.

9. A hammermill as set forth in claim 1 wherein each of said hammers is swingably mounted to said coupling means.

* * * * *